US009161421B2

(12) United States Patent
Mohammediyan et al.

(10) Patent No.: US 9,161,421 B2
(45) Date of Patent: Oct. 13, 2015

(54) SUPPLEMENTAL LOAD CIRCUIT FOR LOW POWER TRAFFIC LAMPS

(71) Applicant: GE Lighting Solutions LLC, East Cleveland, OH (US)

(72) Inventors: Shahriyar Mohammediyan, Lachine (CA); Justin Langlais, Lachine (CA); Truong-Khoa Nguyen, Lachine (CA); Christian Poirier, Lachine (CA)

(73) Assignee: GE LIGHTING SOLUTIONS, LLC, East Cleveland, OH (US)

( * ) Notice: Subject to any disclaimer, the term of this patent is extended or adjusted under 35 U.S.C. 154(b) by 62 days.

(21) Appl. No.: 13/768,666

(22) Filed: Feb. 15, 2013

(65) Prior Publication Data

US 2014/0232279 A1 Aug. 21, 2014

(51) Int. Cl.

| | |
|---|---|
| ***H05B 37/03*** | (2006.01) |
| ***H05B 33/08*** | (2006.01) |
| ***G08G 1/00*** | (2006.01) |

(52) U.S. Cl.

CPC ..... *H05B 37/03* (2013.01); *G08G 1/00* (2013.01); *H05B 33/0803* (2013.01); *H05B 33/0893* (2013.01)

(58) Field of Classification Search

CPC ..... H05B 33/0815; H05B 4/2826
USPC ..... 315/209
See application file for complete search history.

(56) References Cited

U.S. PATENT DOCUMENTS

| | | | | |
|---|---|---|---|---|
| 3,196,387 | A * | 7/1965 | Hill | 340/914 |
| 6,570,505 | B1 | 5/2003 | Malenfant | |
| 7,058,484 | B1 * | 6/2006 | Potega | 700/297 |
| 7,078,870 | B2 * | 7/2006 | Bocchiola | 315/308 |
| 7,127,623 | B2 * | 10/2006 | Potega | 713/300 |
| 7,268,674 | B2 * | 9/2007 | Bohler et al. | 340/426.25 |
| 7,333,027 | B2 | 2/2008 | Bourgault | |
| 7,352,784 | B2 * | 4/2008 | Adams et al. | 372/34 |
| 7,405,528 | B2 * | 7/2008 | Ho et al. | 318/400.25 |

(Continued)

FOREIGN PATENT DOCUMENTS

EP 2288236 A 2/2011

OTHER PUBLICATIONS

TS 808.220, Light Emitting Diode (LED) Traffic Signal Lamp Modules Material Specification; Toronto Transportation; pp. 1-10; Jan. 2012.

(Continued)

*Primary Examiner* — Douglas W Owens
*Assistant Examiner* — Srinivas Sathiraju
(74) *Attorney, Agent, or Firm* — GE Global Patent Operation; Peter T. DiMauro

(57) ABSTRACT

The present disclosure provides a supplemental load circuit configured to provide a supplemental power consumption to enable a lamp unit operating at a low power consumption to operate with a traffic controller configured to test for a higher power consumption. The supplemental load circuit includes a load, power input circuitry configured to receive a DC power signal from the lamp unit, and a control switch configured to receive a control signal having a duty cycle from the lamp unit. The control switch is configured to control application of the DC power signal to the load by the power input circuitry based on the duty cycle of the control signal. The present disclosure also provides a method for enabling a lamp unit to operate with a traffic controller designed for higher power lamp units.

20 Claims, 3 Drawing Sheets

(56) References Cited

U.S. PATENT DOCUMENTS

| | | | | |
|---|---|---|---|---|
| 7,425,798 | B2 * | 9/2008 | St.-Germain | 315/129 |
| 7,701,150 | B2 | 4/2010 | Nguyen | |
| 7,795,820 | B2 | 9/2010 | Housman | |
| 8,283,867 | B2 | 10/2012 | Kanda | |
| 8,344,667 | B1 * | 1/2013 | King | 315/360 |
| 8,497,637 | B2 * | 7/2013 | Liu | 315/225 |
| 8,680,787 | B2 * | 3/2014 | Veskovic | 315/307 |
| 8,717,194 | B2 * | 5/2014 | Nguyen et al. | 340/907 |
| 2004/0212309 | A1 * | 10/2004 | St.-Germain | 315/76 |
| 2005/0270175 | A1 * | 12/2005 | Peddie et al. | 340/907 |
| 2010/0270947 | A1 * | 10/2010 | Chang et al. | 315/294 |
| 2011/0037392 | A1 | 2/2011 | Ghanem | |
| 2011/0068712 | A1 | 3/2011 | Young | |
| 2011/0234123 | A1 * | 9/2011 | Myers et al. | 315/307 |
| 2012/0154176 | A1 * | 6/2012 | Nguyen et al. | 340/907 |

OTHER PUBLICATIONS

Sitraftic MCU-6 Traffic Controller: Designed With the Customer in Mind; Siemens 2008; pp. 1-4.

Traffic Signal Lanterns; Aldridge Traffic Systems; 2010.

Guideline for the Application of New Lamp Types in Road Traffic Signal Systems; ASTRIN Association of Traffic Industries in the Netherlands; Jan. 2004; pp. 1-13.

* cited by examiner

FIG. –2–

SUPPLEMENTAL LOAD CIRCUIT FOR LOW POWER TRAFFIC LAMPS

FIELD OF THE INVENTION

The present subject matter relates to lighting. More particularly, the present subject matter relates to low power traffic lamps and associated circuitry.

BACKGROUND OF THE INVENTION

Generally, traffic light control systems have been specifically designed to operate with incandescent or halogen lamps. Both of these lamp types are relatively high power consumption devices. More recently, the use of LED traffic lamps has found favor for many reasons; including longer life expectancies than previously used lamps, as well as their operation at significantly lower energy consumption rates.

An issue has arisen, however, in that some specific street traffic light controllers expect a load power consumption greatly exceeding that of an LED traffic lamp. In these cases, simply replacing the normally used incandescent or halogen lamp with an LED lamp unit can cause the controller to malfunction or otherwise decide that the lamp unit is burned out and, thus, stop sending AC power signals to the traffic lamp or operate the traffic lamp in a mode in which the "red" lamp unit flashes repeatedly. These situations can cause dangerous conditions for motorists and pedestrians.

In view of these known issues, it would be advantageous, therefore, to provide a circuit for use with LED traffic lamps that will allow existing street traffic light controllers to continue normal operations using LED or other types of low power consumption lamp units.

BRIEF DESCRIPTION OF THE INVENTION

Aspects and advantages of the invention will be set forth in part in the following description, or can be obvious from the description, or can be learned through practice of the invention.

One exemplary aspect of the present disclosure is directed to a supplemental load circuit configured to provide a supplemental power consumption to enable a lamp unit operating at a low power consumption to operate with a traffic controller configured to test for a higher power consumption. The supplemental load circuit includes a load, power input circuitry configured to receive a DC power signal from the lamp unit, and a control switch configured to receive a control signal having a duty cycle from the lamp unit. The control switch is configured to control application of the DC power signal to the load by the power input circuitry based on the duty cycle of the control signal.

Another exemplary aspect of the present disclosure is directed to a traffic lamp. The traffic lamp includes a power converter configured to convert an externally supplied AC power signal into a DC power signal. The traffic lamp also includes a lamp load and the lamp load is powered by the DC power signal. The traffic lamp includes a supplemental load and a control command circuit configured to generate a control signal having a duty cycle. The traffic lamp also includes a control switch configured to control application of the DC power signal to the supplemental load based on the duty cycle of the control signal.

Another exemplary aspect of the present disclosure is directed to a method for enabling a lamp unit to operate with a traffic controller designed for higher power lamp units. The method includes receiving, at a control switch included in a supplemental load circuit, a control signal having a duty cycle. The method also includes receiving, at the supplemental load circuit, a DC power signal from a power converter included in the lamp unit. The method includes applying the DC power signal, using the control switch, to a supplemental load included in the supplemental load circuit based on the duty cycle of the control signal such that the lamp unit operates with the traffic controller.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION OF THE INVENTION

Figure 1:
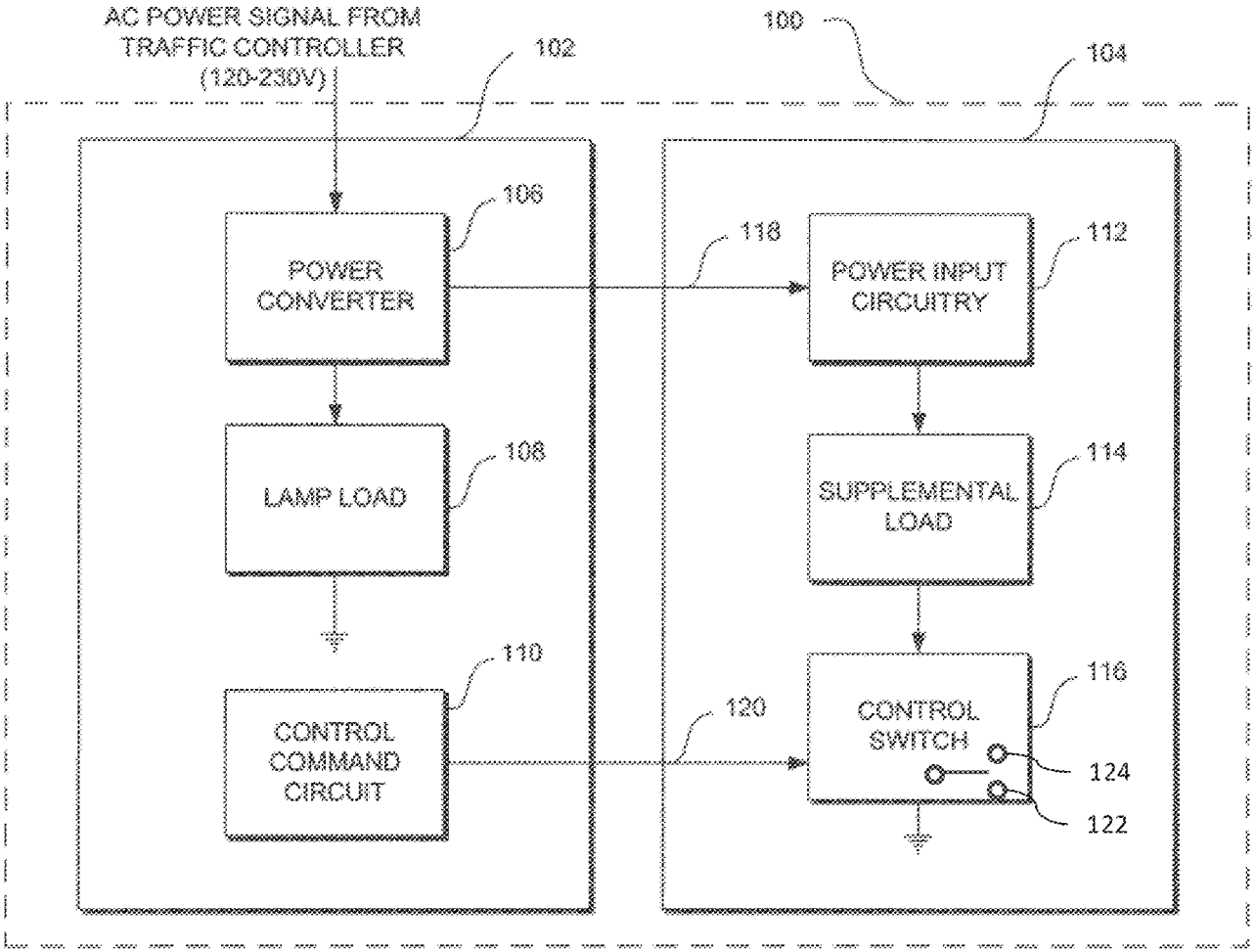
FIG. 1 provides a block diagram of an exemplary traffic lamp in accordance with an exemplary embodiment of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

The present disclosure is generally directed to a supplemental load circuit configured to provide a supplemental power consumption sufficient to enable a low power lamp unit to operate with a traffic controller configured to test for a higher power consumption. In particular, a traffic lamp can include a low power lamp unit and the supplemental load circuit. A supplemental load of the supplemental load circuit can be connected in parallel with a lamp load of the lamp unit and the supplemental load circuit can enable the low power lamp unit to operate with the traffic controller.

The supplemental power consumption provided by the supplemental load circuit can be controlled or otherwise adjusted to obtain a desired supplemental power consumption. Such desired supplemental power consumption can be based on a total power consumption required by the traffic controller and the lamp power consumption. More particularly, the desired supplemental power consumption can be greater than or equal to the total power consumption minus the lamp power consumption. Thus, the supplemental power consumption can be adjusted to satisfy a minimum total power consumption required by the traffic controller and enable a low power lamp unit to operate with a traffic controller designed for higher power lamp units.

According to one aspect of the present disclosure, a control command circuit included within the lamp unit can generate a control signal having a duty cycle. In particular, the duty cycle of the control signal can be adjusted to obtain the desired supplemental power consumption. For example, increasing the duty cycle of the control signal can provide for increased supplemental power consumption while decreasing the duty cycle of the control signal can provide for decreased supplemental power consumption.

According to another aspect of the present disclosure, the control command circuit can be programmed with a plurality of parameters such that the desired control signal can be generated. For example, the duty cycle of the control signal can be adjusted using the pre-programmed parameters. Such plurality of pre-programmed parameters can include a pulse width and a pulse frequency. The parameters can be programmed into the control command circuit at the time of manufacture. In such fashion, the control command circuit can be pre-programmed to provide a control signal having the appropriate duty cycle to obtain the desired supplemental power consumption.

A control switch included in the supplemental load circuit can be configured to control application of a DC power signal to a supplemental load based on the duty cycle of the control signal. For example, the control switch can have a first position permitting application of the DC power signal to the supplemental load and a second position discontinuing application of the DC power signal to the supplemental load. The control switch can actuate between the first and second position based on the duty cycle of the control signal. In such fashion, the supplemental power consumption provided by the supplemental load circuit can be controlled based upon the duty cycle of the control signal.

In the instance in which the duty cycle of the control signal corresponds to a plurality of pulses, the control switch can be configured such that the DC power signal is applied to the supplemental load for the duration of the pulse width. Application of the DC power signal to the supplemental load for the duration of the pulse width can provide the desired supplemental power consumption and enable the low power lamp to operate with the traffic controller.

According to another aspect, the pulse width of the control signal can be synchronized with an externally supplied AC power signal received by the lamp unit. As an example, the center of the pulse width can be synchronized with a peak voltage amplitude associated with the AC power signal. In particular, a pulse frequency can be pre-programmed into the control command circuit such that the pulses are synchronized with the AC power signal. For example, the pre-programmed pulse frequency can be based on the anticipated frequency of the AC power signal received from the traffic controller.

FIG. 1 provides a block diagram of an exemplary traffic lamp 100 in accordance with an exemplary embodiment of the present disclosure. Traffic lamp 100 can include a lamp unit 102 and a supplemental load circuit 104. Lamp unit 102 can include a power converter 106, a lamp load 108, and a control command circuit 110. As will be discussed further, lamp load 108 can include one or more light engines, such as light emitting diode engines. Control command circuit 110 can include one or more microprocessors, controllers, or other suitable components.

Supplemental load circuit 104 can include power input circuitry 112, a supplemental load 114, and a control switch 116. Power input circuitry 112 can include any suitable components for providing power to supplemental load 114. In certain embodiments, power input circuitry can be wiring to electrically connect supplemental load 114 to power converter 106. Control switch 116 can be any suitable type of switch. As shown in FIG. 1, supplemental load 114 can be connected in parallel with lamp load 108.

Power converter 106 of lamp unit 102 can be configured to receive an AC power signal supplied by an external traffic controller (not separately shown). The AC power signal can vary in voltage or other characteristics, but generally is within a range of about 120 to about 230 volts. Power converter 106 can convert such externally supplied AC power signal into a DC power signal. For example, power converter 106 can include a rectifier, smoothing capacitors, filters, or other suitable components for converting AC power to DC power or providing power factor correction.

Power converter 106 can supply such DC power signal to lamp load 108 of lamp unit 102. In addition, power converter 106 can supply such DC power signal (shown as DC power signal 118) to power input circuitry 112 of supplemental load circuit 104. Application of DC power signal 118 to supplemental load 114 by power input circuitry 112 can provide supplemental power consumption.

Lamp load 108 can be any suitable form of lamp load for lighting the traffic lamp. Particularly suitable for use with the present disclosure are LED (light emitting diode) lamps. For example, lamp load 108 can be an LED engine. Such LED engine can contain a plurality of light emitting diodes, LED drivers, input power conditioning elements, or other suitable components.

The power consumption associated with such LED engine can be significantly lower than the power consumption associated with traditional traffic lamp loads such as incandescent or halogen loads. As an example, an exemplary LED load can consume about 10 W while an exemplary halogen load can consume about 50 W. As such, traffic controllers designed for use with incandescent or halogen loads can interpret such reduced power consumption as load failure. Supplemental load circuit 104 can be controlled to provide sufficient supplemental power consumption such that the traffic controller does not reach such an interpretation.

Control command circuit 110 can generate a control signal 120 having a duty cycle. For example, control command circuit 110 can generate control signal 120 based on a plurality of pre-programmed parameters. For example, such parameters can include a pulse width and a pulse frequency. The parameters can be programmed into control command circuit 110 at the time of manufacture.

The duty cycle of control signal 120 can be adjusted by altering the parameters programmed into control command circuit 110. For example, increasing the pulse width parameter programmed into control command circuit 110 can increase the duty cycle of control signal 120 and result in an increased supplemental power consumption. Likewise, increasing the frequency of such pulses can also increase the duty cycle of control signal 120. Conversely, decreasing either the pulse width or the frequency of pulses can result in a decreased supplemental power consumption. In such fashion, the supplemental power consumption provided by the supplemental power circuit can be tailored to provide a desired supplemental power consumption according to the particular traffic controller or lamp unit characteristics.

Figure 3:
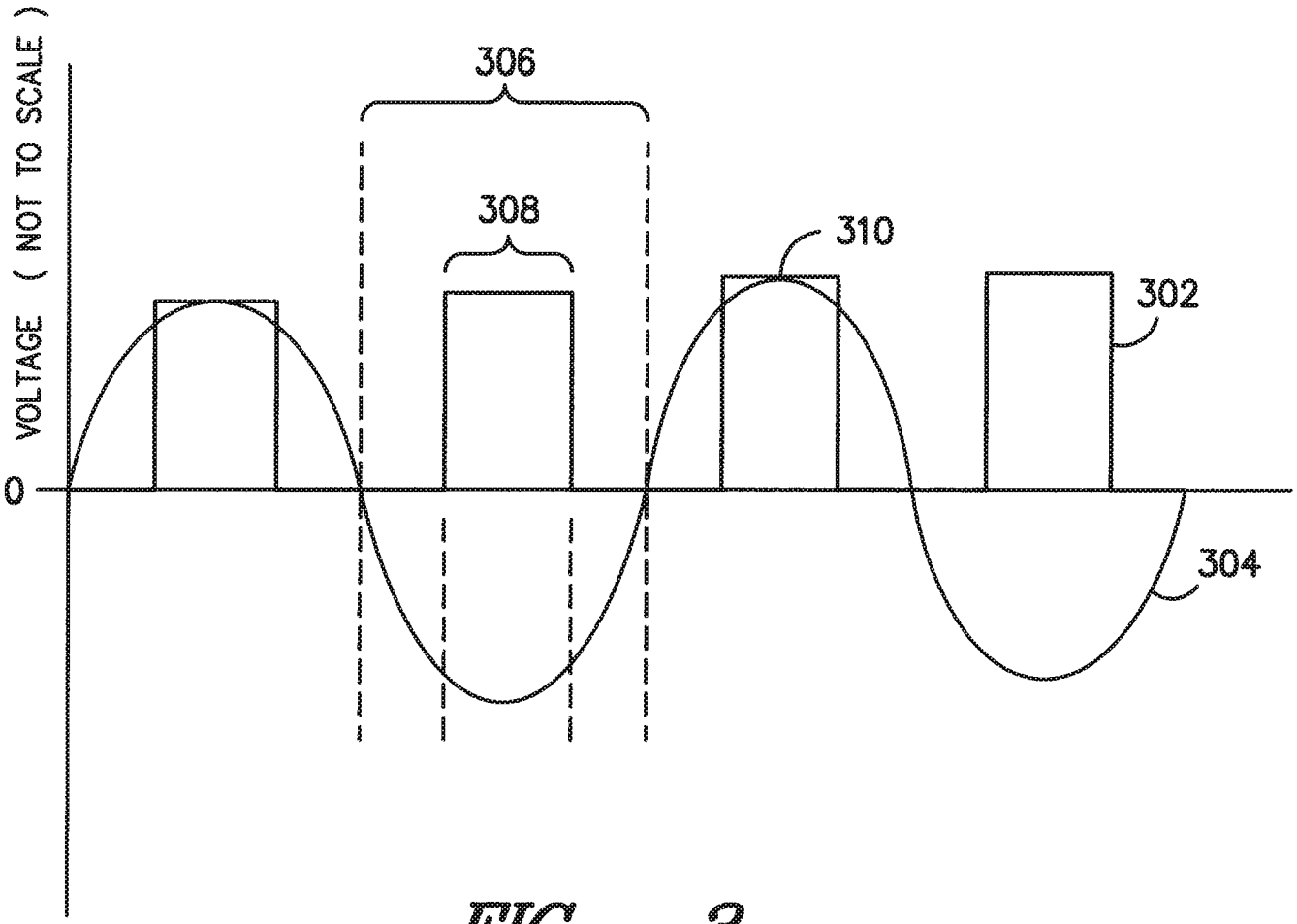
FIG. 3 provides a graphical depiction of an exemplary control signal and an exemplary AC power signal.

FIG. 3 provides a graphical depiction of an exemplary control signal 302 and an exemplary AC power signal 304.

Control signal 302 can have a duty cycle. For example, the duty cycle of control signal 302 can be the percentage of control signal 302 that is above a threshold voltage per signal period 306. As an example, the duty cycle of control signal 302 can be the percentage of period 306 in which control signal 302 is non-zero. Adjusting the duty cycle of control signal 302 can adjust the supplemental power consumed by the supplemental load circuit.

One of skill in the art, in light of the disclosures provided herein, will appreciate that control signal 302 and AC power signal 304, as provided in FIG. 3, are exemplary in nature and simplified for illustration. For example, although control signal 302 and AC power signal 304 are depicted as roughly equivalent in amplitude, the voltage aspect, among other aspects, of FIG. 3 is not drawn to scale. In particular, as discussed above, AC power signal 304 can, in general, range from about 120 to 230V while control signal 302 can be of a significantly lower voltage. For example, control signal 302 can be at about a voltage suitable to operate control switch 116 of FIG. 1. Alternatively, control signal 302 can be at about a voltage suitable to operate a switch driver associated with control switch 116. As such, exemplary control signal 302 can be at about 5V.

In addition, while a period 306 of control signal 302 is depicted in FIG. 3 as corresponding to one-half of a wave of AC power signal 304, one of skill in the art will appreciate that such period can generally be viewed as a matter of convention. In particular, the period associated with control signal 302 can be any appropriate length of time, including twice the length of time associated with depicted period 306.

In the instance in which the pulse frequency of control signal 302 is synchronized with the frequency of AC power signal 304, the duty cycle of control signal 302 can directly correspond to a pulse width of control signal 302. For example, as depicted in FIG. 3, the duty cycle of control signal 302 with respect to period 306 can directly correspond to a pulse width 308. In general, a larger pulse width 308 will correspond to a greater duty cycle while a smaller pulse width 308 will correspond to a lesser duty cycle.

Returning to FIG. 1, control switch 116 can permit application of DC power signal 118 to supplemental load 114 for the duration of a pulse width of the control signal 120. As such, by adjusting the pulse width of control signal 120 using the pre-programmed parameters, the supplemental power consumption provided by supplemental load circuit 104 can be adjusted. If the pulse width of control signal 120 is increased, control switch 116 can permit the application of DC power signal 118 to supplemental load 114 for an increased period of time, thereby increasing the resulting supplemental power consumption. Likewise, supplemental power consumption can be decreased by pre-programming control command circuit 110 to generate a control signal with smaller pulse widths.

According to another aspect of the present disclosure, the pulse widths of control signal 120 can be synchronized with the AC power signal received by power converter 106. For example, referring to FIG. 3, the center of the pulse widths of control signal 302 can be synchronized with a peak voltage amplitude associated with AC power signal 304, as shown at 310. Synchronizing the pulse widths in such fashion can improve the probability that supplemental load circuit 104 is dissipating the desired supplemental power consumption during the appropriate time frame. In one implementation, the pulse widths are synchronized with the AC power signal by pre-programming the control command circuit 110 with a pulse frequency that matches the anticipated frequency of the AC power signal received from the traffic controller.

Returning to FIG. 1, supplemental load circuit 104 is not designed to have any control over the light source generated by lamp unit 102. Rather, lamp unit 102 determines the operating condition (ON/OFF) based on the AC input signal amplitude and frequency received by power converter 106. For example, a scaled down full wave rectified input voltage signal can be measured. Once lamp unit 102 is turned ON, control command circuit 110 can provide control signal 120 to the supplemental load circuit 104.

Supplemental load circuit 104 does not measure the input current or voltage received by power converter 106, but instead receives a control signal 120 from control command circuit 110 only when it needs to be activated. In this way, the supplemental load circuit 104 is dependent on the functionality of the lamp unit 102 to operate. If the lamp unit 102 is to be disabled, then the supplemental load circuit 104 will automatically also be disabled. This method insures that the traffic controller system will "see" no power consumption when lamp unit 102 is disabled.

Furthermore, because supplemental load circuit 104 is in parallel with lamp load 108 and receives DC power signal 118 from power converter 106, the supplemental power consumption provided by supplemental load circuit 104 is indistinguishable, from the perspective of the traffic controller, from the lamp power consumption associated with lamp load 108. As such, the supplemental power consumption provided by supplemental load circuit 104 can be used to "fool" the traffic controller with respect to the amount of power consumed by lamp unit 102.

Supplemental load circuit 104 can be provided as a printed circuit option board. Such boards can be coupled to existing street traffic light control systems or interconnected using, for example, edge connectors or other appropriate connections. In yet alternative embodiments, supplemental load circuit 104 can be incorporated directly into a lamp unit constructed of one or more LED devices, such as lamp unit 102, to form a composite traffic lamp that can be directly substituted for a previously used incandescent or other type of higher power consuming light producing device.

Further still, a supplemental load circuit 104 constructed in accordance with embodiments of the present disclosure can allow low power consumption lamps, including LED lamps and other more efficient traffic lamps, to work with traditional traffic controllers that were originally manufactured to work with incandescent lamps. It should be apparent to those of ordinary skill in the art that embodiments of the present technology will help to save energy in a "green" fashion and ultimately save money.

In addition, it should be appreciated by those of ordinary skill in the art that various exemplary circuits are usable for the block diagram of FIG. 1 and can be provided in many different forms. For example, the functionality of these various circuits can be provided in whole or in part by a processor, controller, microcontroller, computer, application specific integrated circuit (ASIC) device, any form of hardware circuitry or similar such devices or circuitry without limitation. Control for such devices can be provided in software or firmware in combination with appropriate hardware.

Figure 2:
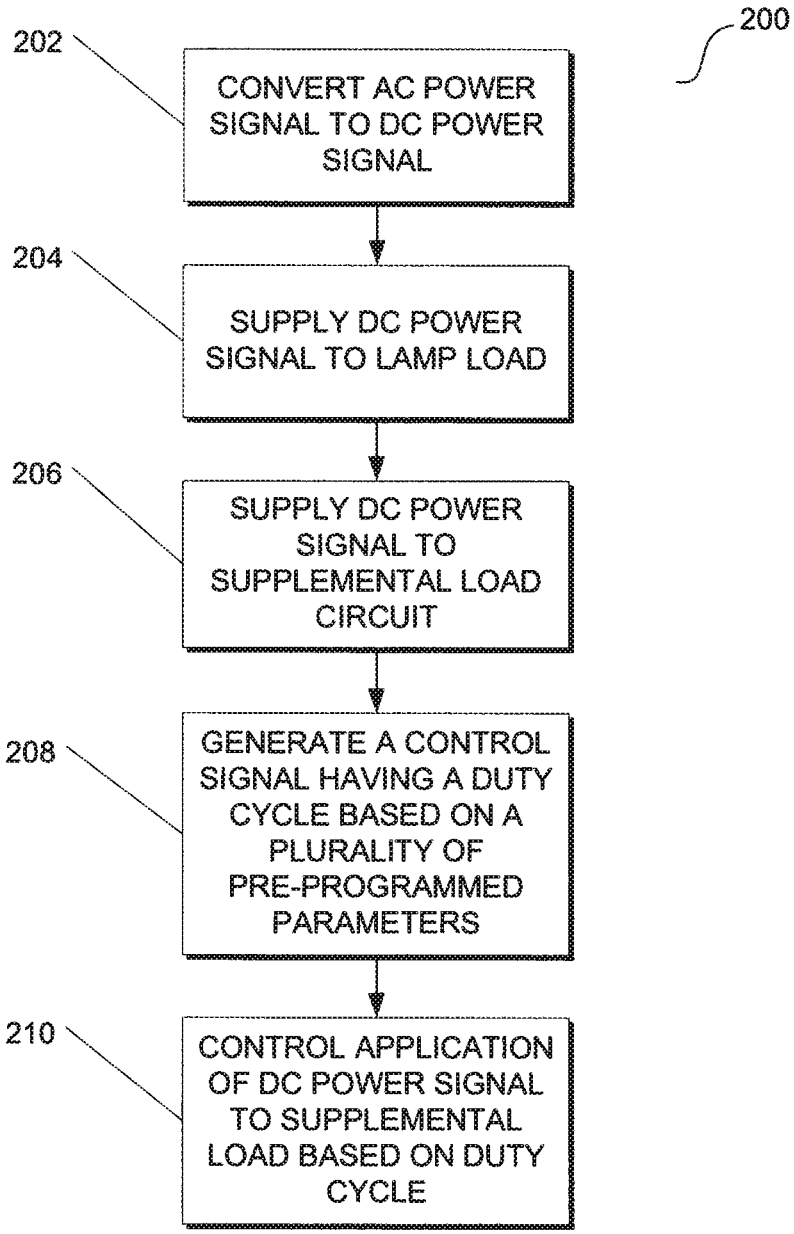
FIG. 2 provides a flowchart of an exemplary method for enabling a low power lamp unit to operate with a traffic controller designed for higher power lamp units in accordance with an exemplary embodiment of the present disclosure.

FIG. 2 provides a flowchart of an exemplary method (200) for enabling a low power lamp unit to operate with a traffic controller designed for higher power lamp units in accordance with an exemplary embodiment of the present disclosure. While exemplary method (200) will be discussed with reference to FIG. 1, exemplary method (200) can be implemented using any suitable traffic lamp. In addition, although FIG. 2 depicts steps performed in a particular order for purposes of illustration and discussion, the methods discussed herein are not limited to any particular order or arrangement. One skilled in the art, using the disclosures provided herein, will appreciate that various steps of the methods disclosed herein can be omitted, rearranged, combined, and/or adapted in various ways without deviating from the scope of the present disclosure.

At (202) an externally supplied AC power signal can be converted into a DC power signal. For example, power converter 106 can convert the AC power signal received from the traffic controller into a DC power signal.

At (204) the DC power signal can be supplied to a lamp load. For example, as shown in FIG. 1, power converter 106 can supply the DC power signal to lamp load 108. Lamp load 108 can use the DC power signal to produce lighting for the traffic lamp.

At (206) the DC power signal can be supplied to a supplemental load circuit. For example, power converter 106 can supply DC power signal 118 to supplemental load circuit 104. In particular, power converter 106 can supply DC power signal 118 to power input circuitry 112. Power input circuitry 112 can be any suitable components for receiving DC power signal 118 from power converter 106 and applying such signal to supplemental load 114.

At (208) a control signal having a duty cycle can be generated based on a plurality of pre-programmed parameters. For example, control command circuit 110 can generate control signal 120 and control signal 120 can have a duty cycle. Control command circuit 110 can generate control signal 120 based on a plurality of parameters which can be programmed into control command circuit 110 at the time of manufacture.

The pre-programmed parameters can be adjusted such that control signal generated at (208) has an appropriate duty cycle to dissipate the desired supplemental power. For example, a lamp power consumption associated with lamp load 108 can be determined prior to programming control command circuit 110. A desired supplemental power consumption can be calculated based on the total power consumption required by the traffic controller and the lamp power consumption. In particular, the desired power consumption can be greater than or equal to a difference between the lamp power consumption and the total power consumption. The pre-programmed parameters can be adjusted to achieve the desired power consumption.

The pre-programmed parameters can include a pulse width and a pulse frequency. In such fashion, the duty cycle of control signal 120 can be based on the desired supplemental power consumption. For example, increasing the duty cycle of control signal 120 can result in an increased supplemental power consumption. Likewise, decreasing the duty cycle can result in a decreased supplemental power consumption. In such fashion, the pre-programmed parameters can be adjusted to enable any particular low power lamp unit to operate with any particular traffic controller.

At (210) application of the DC power signal to the supplemental load is controlled based upon the duty cycle of the control signal generated at (208). For example, control switch 116 can have a first position 122 permitting application of the DC power signal to supplemental load 114 by power input circuitry and a second position 124 discontinuing such application. Control switch 116 can be actuated between the first position 122 and the second position 124 based on the duty cycle of control signal 110. In such fashion, the application of the DC power signal to the supplemental load can be controlled.

This written description uses examples to disclose the invention, including the best mode, and also to enable any person skilled in the art to practice the invention, including making and using any devices or systems and performing any incorporated methods. The patentable scope of the invention is defined by the claims, and can include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A supplemental load circuit configured to provide a supplemental power consumption to enable a lamp unit operating at a low power consumption to operate with a traffic controller configured to test for a higher power consumption, the supplemental load circuit comprising:

a load;

power input circuitry configured to receive a DC power signal from the lamp unit; and a control switch configured to receive a control signal having a duty cycle from the lamp unit;

wherein the control switch is configured to control application of the DC power signal to the load by the power input circuitry based on the duty cycle of the control signal to provide the higher power consumption for which the traffic controller is configured to test.

2. A supplemental load circuit as in claim 1, wherein the control switch comprises:

a first position permitting application of the DC power signal to the load by the power input circuitry; and a second position discontinuing application of the DC power signal to the load by the power input circuitry;

wherein the control switch actuates between the first position and the second position based on the duty cycle of the control signal.

3. A supplemental load circuit as in claim 1, wherein the duty cycle of the control signal corresponds to a pulse width of the control signal and the control switch is configured such that the DC power signal is applied to the load for the duration of the pulse width.

4. A supplemental load circuit as in claim 3, wherein application of the DC power signal to the load for the duration of the pulse width provides the supplemental power consumption, the supplemental power consumption being sufficient to enable the lamp unit to operate with the traffic controller.

5. A supplemental load circuit as in claim 3, wherein:

the lamp unit operates at a first power consumption and the traffic controller is configured to test for a second power consumption, the second power consumption being greater than the first power consumption; and application of the DC power signal to the load for the duration of the pulse width provides the supplemental power consumption, the supplemental power consumption being greater than or equal to the second power consumption minus the first power consumption.

6. A supplemental load circuit as in claim 3, wherein the pulse width of the control signal is synchronized with an external AC power signal received by the lamp unit.

7. A supplemental load circuit as in claim 1, wherein the load is connected in parallel with a light emitting diode engine included in the lamp unit.

8. A traffic lamp operating at a low power consumption and controlled by a traffic controller configured to test for higher power consumption comprising:

a power converter configured to convert an externally supplied AC power signal into a DC power signal;

a lamp load, the lamp load being powered by the DC power signal;

a supplemental load;

a control command circuit configured to generate a control signal having a duty cycle; and a control switch configured to control application of the DC power signal to the supplemental load based on the duty cycle of the control signal to provide the higher power consumption for which the traffic controller is configured to test.

9. A traffic lamp as in claim 8, wherein application of the DC power signal to the supplemental load based on the duty cycle of the control signal provides a supplemental power consumption sufficient to allow the traffic lamp to operate with a traffic controller configured to test for a total power consumption, the total power consumption being greater than a lamp power consumption associated with the lamp load.

10. A traffic lamp as in claim 8, wherein the control command circuit is configured to generate the control signal based on a desired supplemental power consumption, the desired supplemental power consumption being based on a total power consumption required by a traffic controller and a lamp power consumption associated with the lamp load.

11. A traffic lamp as in claim 10, wherein:

the duty cycle of the control signal corresponds to a pulse width of the control signal;

the control switch is configured such that the DC power signal is applied to the supplemental load for the duration of the pulse width of the control signal; and application of the DC power signal to the supplemental load for the duration of the pulse width provides a supplemental power consumption greater than or equal to the desired supplemental power consumption.

12. A traffic lamp as in claim 11, wherein the desired supplemental power consumption equals the difference between the total power consumption and the lamp power consumption.

13. A traffic lamp as in claim 8, wherein the control command circuit generates the control signal based on a plurality of pre-programmed parameters.

14. A traffic lamp as in claim 13, wherein the plurality of pre-programmed parameters comprise:

a pulse width; and a pulse frequency.

15. A traffic lamp as in claim 14, wherein the pulse frequency corresponds to the frequency of the externally supplied AC power signal.

16. A traffic lamp as in claim 8, wherein the lamp load comprises a light emitting diode engine and the supplemental load is connected in parallel with the light emitting diode engine.

17. A method for enabling a lamp unit operating at a low power consumption to operate with a traffic controller configured to test for a higher power consumption, the method comprising:

receiving, at a control switch included in a supplemental load circuit, a control signal having a duty cycle;

receiving, at the supplemental load circuit, a DC power signal from a power converter included in the lamp unit; and applying the DC power signal, using the control switch, to a supplemental load included in the supplemental load circuit based on the duty cycle of the control signal such that the lamp unit operates with the traffic controller and provides the higher power for which the traffic controller is configured to test.

18. A method as in claim 17, further comprising:

converting, at the power converter, an externally supplied AC power signal into the DC power signal;

supplying the DC power signal from the power converter to the supplemental load circuit; and supplying the DC power signal from the power converter to a lamp load included in the lamp unit.

19. A method as in claim 17, further comprising generating, with a control command circuit included in the lamp unit, the control signal having the duty cycle based on a plurality of pre-programmed parameters, the pre-programmed parameters including a pulse width and a pulse frequency.

20. A method as in claim 17, wherein the duty cycle of the control signal corresponds to a pulse width of the control signal and applying the DC power signal, using the control switch, to the supplemental load included in the supplemental load circuit based on the duty cycle of the control signal comprises applying the DC power signal, using the control switch, to the supplemental load for the duration of the pulse width of the control signal.

* * * * *